US007370776B2

(12) United States Patent
Gomi

(10) Patent No.: US 7,370,776 B2
(45) Date of Patent: May 13, 2008

(54) TABLE FOR SUPPLYING LIQUID FOR DRINKING

(75) Inventor: Toyoaki Gomi, Tokyo (JP)

(73) Assignee: St Legend Co., Ltd., Atsugi-shi, Kanagawa (JP)

( * ) Notice: Subject to any disclaimer, the term of this patent is extended or adjusted under 35 U.S.C. 154(b) by 406 days.

(21) Appl. No.: 10/892,823

(22) Filed: Jul. 16, 2004

(65) Prior Publication Data

US 2006/0011650 A1 Jan. 19, 2006

(51) Int. Cl.
*B67D 5/06* (2006.01)

(52) U.S. Cl. ..... 222/23; 222/146.6

(58) Field of Classification Search ..... 222/23, 222/1, 32, 36, 39, 71, 77, 146.1, 399, 146.6; 62/390, 389, 393, 400
See application file for complete search history.

(56) References Cited

U.S. PATENT DOCUMENTS 2,362,104 A * 11/1944 Smith ..... 62/390
2,618,938 A * 11/1952 Booth et al. ..... 62/64
3,625,399 A * 12/1971 Heisler ..... 222/56
3,790,039 A * 2/1974 Zucconi ..... 222/394
4,306,457 A * 12/1981 Fukui et al. ..... 73/861.77
5,090,440 A * 2/1992 Ladouceur et al. ..... 137/209
5,115,942 A * 5/1992 Merrill et al. ..... 222/1
5,303,845 A * 4/1994 Osawa ..... 222/1
5,651,663 A * 7/1997 Pluss ..... 417/20
6,565,103 B2 * 5/2003 Wilson ..... 280/47.24
6,666,358 B1 * 12/2003 Field ..... 222/400.7

FOREIGN PATENT DOCUMENTS

JP 4-115199 U 10/1992

* cited by examiner

*Primary Examiner*—Lien M. Ngo
(74) *Attorney, Agent, or Firm*—Flynn, Thiel, Boutell & Tanis, P.C.

(57) ABSTRACT

The present invention discloses a table for supplying a liquid for drinking which can accurately measure the amount of discharged liquid for drinking. The invention provides a table for supplying liquid for drinking provided with a table, a liquid discharging server installed in the table, and a liquid storage tank for supplying liquid for drinking to the liquid discharging server, in which a measuring mechanism for measuring the discharging liquid amount is provided, and the measuring mechanism has a function of measuring only in a state in which a forward liquid passage reaching the liquid discharging server is filled with the liquid for drinking. In accordance with the invented table, since the customer can discharge the liquid for drinking to the container on the spot by himself or herself, no waiting time is generated and the required amount of liquid can be injected so as to obtain an economical effect.

9 Claims, 8 Drawing Sheets

TABLE FOR SUPPLYING LIQUID FOR DRINKING

TECHNICAL FIELD

The present invention relates to a table for supplying a liquid for drinking such as beer or the like, and more particularly to a table for supplying a liquid for drinking by which a customer can meter and discharge the necessary amount on the basis of his or her own operation.

BACKGROUND ART

A conventional dispenser for supplying a liquid for drinking is placed together with a carbon dioxide bottle or a barrel filled with the liquid for drinking, in a place other than customer's seats, for example, a kitchen or the like.

In the case that a shop tender receives an order from the customer in the seat, the shop tender walks to the place where the dispenser is placed, inputs an ordered number of a liquid for drinking to containers (steins or the like) via the dispenser, and carries the containers to the customer's seat.

When receiving an additional order from the customer, the shop tender temporarily returns to the place of the dispenser while holding the empty container, injects the liquid for drinking into a new stein after being washed at the place, and carries it to the customer's seat again.

In particular, when the orders of the customers are concentrated at the same time, a plurality of shop tenders have the dispenser in common, so that it is necessary that the shop tenders wait for the dispenser and it is hard to rapidly respond to the order.

On the other hand, the customer drinks the liquid for drinking which is delivered at a fixed time after the customer calls and places an order and cannot drink immediately when the customer wants to drink due to a waiting time.

Further, there is a case that the customer wants to order about half of the amount of the liquid for drinking in the container, however, normally, since the customer can only order a prescribed amount of injected liquid for drinking, the customer leaves part of the liquid for drinking, which is wasteful and uneconomical for the customer.

On the other hand, the customer holds back an order, and the shop cannot get turnover.

On the other hand, for the shop, it is necessary to provide a lot of shop tenders in order to rapidly respond to the orders of the customers so the labor cost is large for the shop.

Further, when settling the drinking money, there is a case that money trouble is generated between the customer and the shop side with regard to the cost demand because the customer has a small recognition about the drinking amount.

In order to solve the problem mentioned above, there has been developed a table in which a draft tower is placed as disclosed in Japanese Unexamined Utility Model Publication No. 4-115199.

In accordance with this invention, the draft tower for discharging beer is placed in a customer's seat table and the discharge amount from the draft tower is measured so as to be displayed in integrating meters provided in positions near the customer's seat and a cash register of the shop.

Accordingly, it is not necessary to order the shop tender at a time of placing an order for the liquid for drinking, and the customer can immediately discharge a necessary amount of liquid for drinking at a time when the customer wants to drink.

Further, the customer cannot only enjoy the operation of discharging the liquid for drinking, but also can have the liquid for drinking while confirming the discharge amount (drinking cost) by himself or herself. Accordingly, the customer has a sense of security. Further, since the customer can confirm the drinking amount by himself or herself, it is possible to prevent trouble with respect to money.

Further, for the shop side, it is not necessary to prepare new washed containers, it is unnecessary to provide the shop tenders, and the cost is extremely efficient.

However, for a flow meter in the conventional draft tower, a so-called axial flow type meter in which an axis of impeller is set in parallel to a flow is employed because its principle and structure are simple and the cost is advantageous.

In other words, the flow meter utilizes the principle that the impeller rotates at a speed in proportion to the flow speed of the fluid obtained by arranging the axis of the impeller in parallel to the fluid flowing within a flow passage, and determines the flow rate by detecting a rotational speed.

However, in the conventional flow meter mentioned above, since the flow meter utilizes a physical rotation caused by the impeller, there is a problem when the flow meter measures the liquid for drinking containing the carbon dioxide gas such as beer or the like, the impeller is rotated in the same manner even at a time when the liquid-cut state is formed and the flow passage is in a bubble or gas state, and the flow meter erroneously counts.

In the draft tower placed in the table of the customer's seat, since the charge is left up to the customer, it is necessary to extremely accurately measure the injection amount of the liquid for drinking.

In the case that the liquid amount is counted and the liquid for drinking is not actually injected although the customer injects, confidence in the shop deteriorates.

On the basis of the matter mentioned above, there has been desired a draft tower which can accurately measure a liquid amount of the liquid for drinking.

SUMMARY OF THE INVENTION

The present invention is made for the purpose of solving the problem mentioned above on the basis of the actual condition mentioned above.

In other words, an object of the present invention is to provide a table for supplying a liquid for drinking which can accurately measure the amount of liquid discharged for drinking.

Accordingly, the inventor of the present invention has found that an erroneous measurement of liquid for drinking can be avoided by adding a so-called sensor for detecting whether or not the liquid exists to an impeller in a liquid passage of a measuring mechanism, as a result of devoting himself to research the problem mentioned above, and completed the present invention on the basis of the knowledge.

In other words, in accordance with the present invention, there is provided (1) a table for supplying a liquid for drinking, a liquid discharging server installed in the table, and a liquid storage tank supplying the liquid for drinking to the liquid discharging server, comprising:

a measuring mechanism for measuring the discharged liquid amount, wherein the measuring mechanism has a function of measuring only in a state in which a forward liquid passage reaching the liquid discharging server is filled with the liquid for drinking.

Further, in accordance with the present invention, there is provided (2) a table for supplying a liquid for drinking, a liquid discharging server installed in the table, and a liquid storage tank supplying the liquid for drinking to the liquid discharging server, wherein a measuring mechanism for measuring the discharged liquid amount is provided between the liquid discharging server and the liquid storage tank, the measuring mechanism is provided with an impeller rotated by the liquid for drinking flowing through a liquid passage within a housing, an impeller rotation detecting portion for detecting the rotation of the impeller, and a liquid detecting portion for detecting whether or not the liquid passage is filled with the liquid for drinking, and a pulse signal measuring the liquid amount is detected by an impeller rotation signal output from the impeller rotation detecting portion and a liquid fullness signal is output from the liquid detecting portion.

Further, there is provided (3) a table for supplying a liquid for drinking as described in the item (1) mentioned above, wherein a cooling mechanism for cooling the liquid for drinking is provided between the liquid storage tank and the liquid discharging server.

Further, there is provided (4) a table for supplying a liquid for drinking as described in the item (3) mentioned above, wherein the cooling mechanism is provided with an ice receiving container and a cooling plate and is structured such as to cool the liquid for drinking by circulating the liquid for drinking through the cooling plate.

Further, there is provided (5) a table for supplying a liquid for drinking as described in the item (1) mentioned above, wherein the liquid storage tank is received in a lower side of the table.

Further, there is provided (6) a table for supplying a liquid for drinking as described in the item (1) mentioned above, wherein the liquid storage tank is provided with casters and is structured so as to be movable.

Further, there is provided (7) a table for supplying a liquid for drinking as described in the item (1) mentioned above, wherein a display portion detecting and displaying the liquid amount measured by the measuring mechanism is provided in a counter which is apart from the table.

Further, there is provided (8) a table for supplying a liquid for drinking as described in the item (1) mentioned above, wherein a plurality of liquid discharging servers are placed in the table.

Further, there is provided (9) a table for supplying a liquid for drinking as described in the item (8) mentioned above, wherein a communication pipe 10*b* for feeding the liquid for drinking to the liquid discharging server is provided with a check valve allowing the liquid for drinking to fluidize only in one direction corresponding to a discharging direction.

Further, there is provided (10) a table for supplying a liquid for drinking as described in the item (1) mentioned above, wherein a cooling mechanism for cooling the liquid for drinking and a refrigerating mechanism for cooling the liquid for drinking to a minus temperature are provided between the liquid storage tank and the liquid discharging server.

The present invention can, of course, employ a structure obtained by combining two or more selected from the items 1 to 10 mentioned above as far as it is along the object of the present invention.

As described above, in accordance with the table for supplying liquid for drinking of the present invention, since the customer can discharge the liquid for drinking to the container on the spot by himself or herself, no waiting time is generated and a required amount of liquid can be injected so as to obtain an economical effect.

On the other hand, it is possible to reduce the number of shop tenders for responding to the orders of the customers, in the shop side, the burden of the labor cost is reduced, and the customer can recognize the results obtained by measuring the discharged amount so as to prevent trouble with respect to money.

Since the structure is provided with a measuring mechanism for measuring the discharged liquid amount, the impeller rotation detecting portion for detecting the rotation of the impeller and the liquid detecting portion for detecting whether or not the liquid passage is filled with the liquid for drinking, the measuring operation can be carried out only in a state in which the liquid is filled, it is possible to securely avoid the erroneous measurement of the liquid for drinking as in the conventional structure, and it is possible to accurately measure the discharged liquid.

BRIEF DESCRIPTION OF THE DRAWINGS

FIGS. 3A and 3B are views schematically showing a measuring mechanism, in which FIG. 3A is a partly broken perspective view, and FIG. 3B is a perspective view showing an arrangement of a magnetic body provided in an impeller;

FIGS. 6A and 6B are schematic views showing an arrangement of a cooling mechanism, a liquid discharging server and a sub set, in which FIG. 6A is a side elevational view and FIG. 6B is a top elevational view;

DESCRIPTION OF THE PREFERRED EMBODIMENTS

A description will be given below of embodiments in accordance with the present invention with reference to the accompanying drawings.

Figure 1:
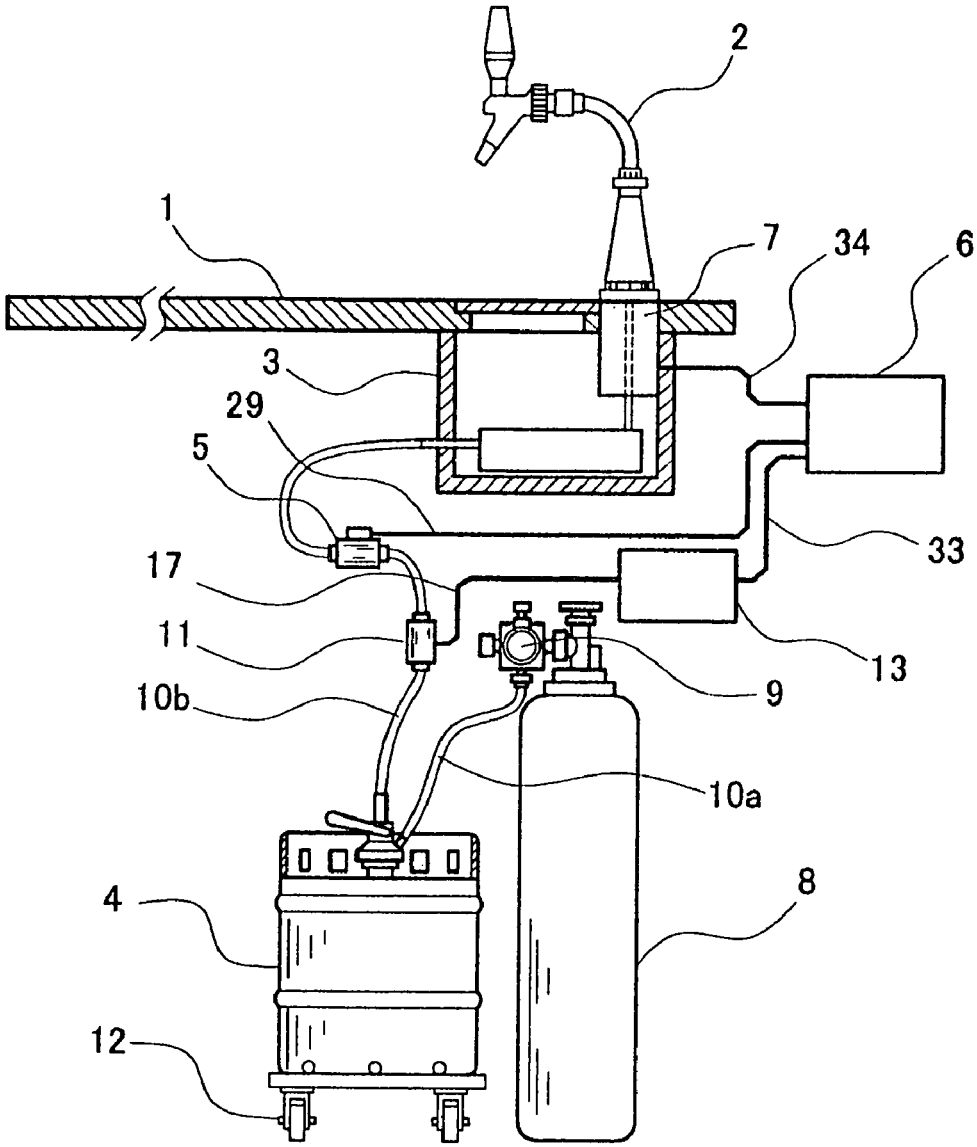
FIG. 1 is a schematic view schematically showing a table for supplying a liquid for drinking.

FIG. 1 is a schematic view schematically showing a table for supplying a liquid for drinking provided with a liquid discharging server 2 in accordance with an embodiment of the present invention.

The present table for supplying a liquid for drinking is provided with a table 1, a liquid discharging server 2 installed in the table 1, a cooling mechanism 3 for supplying a cooled liquid for drinking (for example, beer) and a liquid storage tank 4 for supplying the liquid for drinking to the cooling mechanism 3.

Further, the table for supplying liquid for drinking 1 is provided with a measuring mechanism 5 for measuring the amount of the liquid discharged through the liquid discharging server 2, between the liquid discharging server 2 and the liquid storage tank 4, in other words, in a forward liquid passage reaching the liquid discharging server.

The liquid amount (that is, the discharged liquid amount) of the liquid for drinking measured by the measuring mechanism 5 can be displayed on a display portion of a digital box 6 provided in a counter (not shown) which is apart from the table 1.

An amount of money can be, of course, displayed by converting the discharged liquid amount into an amount of money.

Further, the table 1 is provided with a sub set 7 for displaying a flow rate value on the basis of a pulse signal output from the digital box 6.

Further, a liquid-cut detecting mechanism 13 is provided for detecting a liquid-cut of the liquid for drinking.

The liquid storage tank 4 is received in a lower side of the table 1 as shown in FIG. 1, and a gas cylinder 8 for supplying a pressurized carbon dioxide gas for discharging the liquid for drinking, for example, the beer or the like is connected thereto by a communication pipe 10*a* via a pressure reducing valve 9.

Further, the liquid storage tank 4 is connected to the measuring mechanism 5 by a communication pipe 10*b* via a liquid-cut detecting sensor 11 attached to the liquid-cut detecting mechanism 13, and the measuring mechanism 5 is connected to the cooling mechanism 3 provided in the table 1 through the communication pipe 10*b*.

Further, the liquid storage tank 4 is provided with casters 12 and can freely move by detaching the communication pipes 10*a* and 10*b* connecting between the liquid-cut detecting sensor 11 and the pressure reducing valve 9 when the liquid in the liquid storage tank 4 runs short, and can be replaced by a new one.

Figure 2:
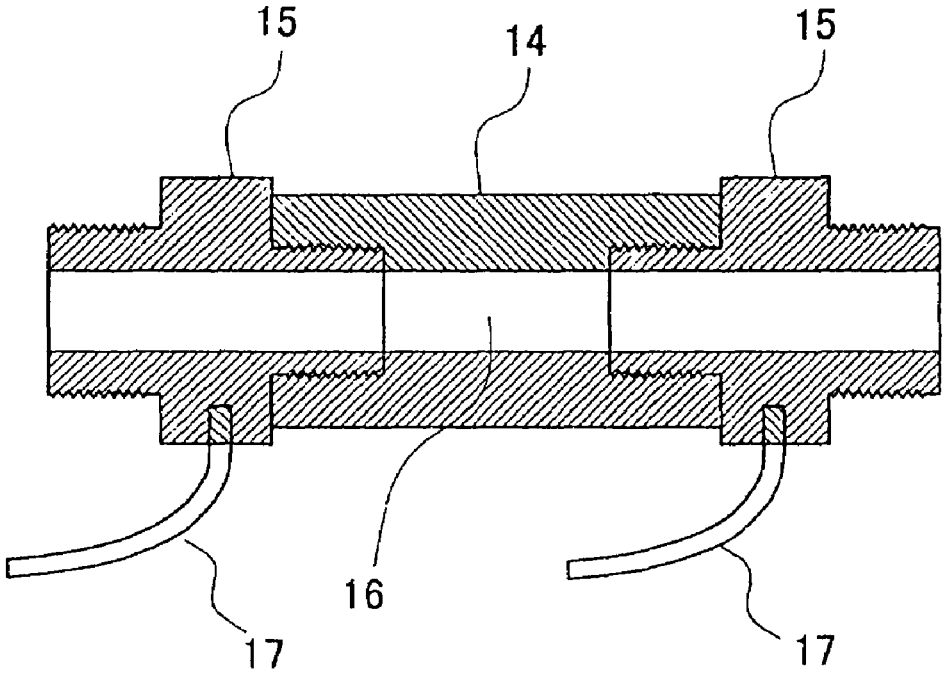
FIG. 2 is a cross sectional view of a liquid-cut detecting sensor constituting a liquid-cut detecting mechanism.

The liquid-cut detecting sensor 11 is provided with two electrodes which are placed within a tubular housing, as shown in FIG. 2, and each of the electrodes is arranged in a state of being apart from each other.

In other words, the liquid-cut detecting sensor 11 is provided with conductive connection pipes 15 and 15 serving as electrodes in both ends of a nonconductive tube 14, and each of the electrodes is connected to the liquid-cut detecting mechanism 13 through a wiring 17.

Further, the liquid-cut detecting mechanism 13 has a function of measuring a current flowing therethrough by applying a predetermined voltage between the electrodes via the wiring 17.

In other words, the current flows by setting the liquid for drinking filled within the housing 16 to an electric load, on the basis of the voltage applied between the conductive connection pipes 15 and 15, and the liquid-cut detecting mechanism 13 can detect whether or not the liquid passage within the housing 16 is filled with the liquid for drinking, on the basis of the measured current value.

In other words, when the liquid for drinking is filled within the housing 16, the current flows on the basis of a short circuit between the electrodes due to the conductive property of the liquid for drinking.

However, in the case that the liquid for drinking is not filled within the housing 16, that is, the conductive liquid for drinking is not filled between the electrodes, the current is hard to flow.

Accordingly, the liquid-cut detecting mechanism 13 can detect whether or not the liquid for drinking is filled within the housing 16, by measuring the current between the electrodes.

In this case, it is possible to determine whether or not the liquid for drinking is filled, by selecting the standard current value.

In the case that the liquid-cut (the state in which the liquid is not filled) is detected, the liquid-cut detecting mechanism 13 outputs a liquid-cut signal for controlling a lighting of a liquid-cut lamp provided in the digital box 6 through a wiring 33.

Further, the liquid-cut signal can be structured such as to sound a warning buzzer provided in the digital box 6.

In this case, a sufficient interval is provided between the electrodes of the liquid-cut detecting sensor so as to prevent the electrodes from being short circuited by the remaining liquid of the liquid for drinking in a state in which the liquid for drinking is not filled.

Further, the remaining liquid may be prevented from being generated possibly, by applying a water repellant treatment to an inner side of the housing 16.

Next, a description will be given of the measuring mechanism 5.

The measuring mechanism 5 is provided with an impeller rotated by the liquid for drinking flowing through the liquid passage in the inner surface of the housing 16, and the liquid amount of the discharged liquid for drinking can be measured by the rotational speed of the impeller.

Figure 3A:
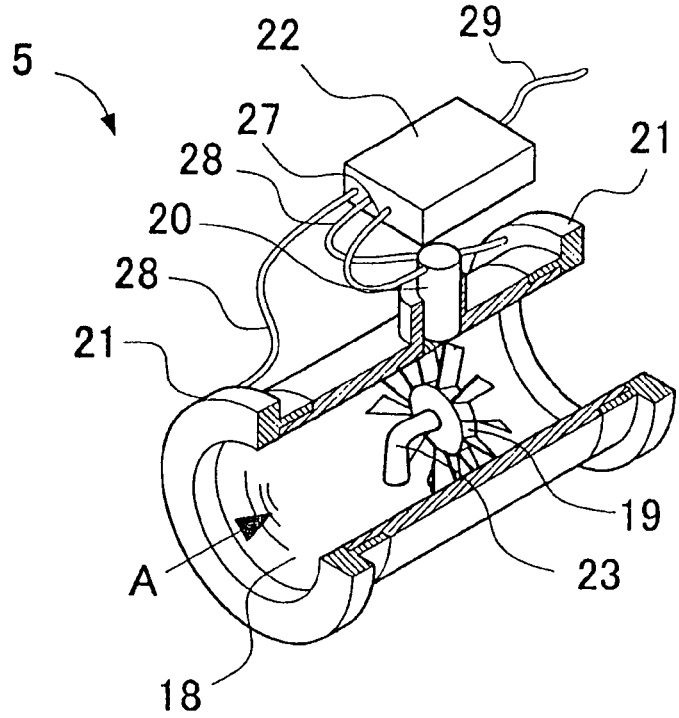

The measuring mechanism is schematically shown in FIG. 3A.

As illustrated, the measuring mechanism 5 is provided with a nonconductive tubular housing 18, an impeller 19, a pickup coil 20, conductive connection pipes 21 and 21 and a rotational pulse generating portion 22.

The impeller 19 is placed such that an axis thereof is in parallel to a direction A in which the liquid for drinking within the tubular housing 18 flows.

Further, the impeller 19 is arranged so as to be rotatable by a bearing 23 supported at a center position within the housing 18.

Figure 3B:
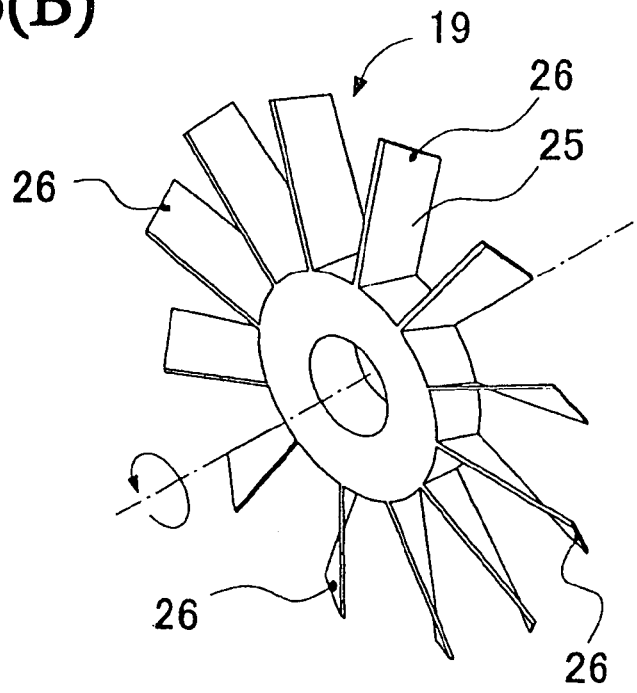

Further, in accordance with the embodiment as shown in FIG. 3B, a magnetic body 26 is mounted to an outer end portion of a blade 25 of the impeller 19 in accordance with an embedding or the like.

In this embodiment, twelve blades 25 are provided in the impeller 19, however, four magnetic bodies 26 are mounted so as to skip two blades 25 (at an angle of 90 degrees).

On the other hand, the pickup coil 20 is provided at a housing position corresponding to an outer peripheral side of the impeller 19, and is arranged so as to detect a rotating magnetic field on the basis of the rotation of the impeller 19.

In other words, the pickup coil 20 is structured such that a periodically changing peak signal is generated by setting a time point when the magnetic body 26 of the impeller 19 comes closest to the pickup coil 20 as a peak.

Further, the conductive connection pipes 21 and 21 serving as two electrodes for detecting whether or not the liquid for drinking exists are provided at positions opposing each other within the housing 18.

The conductive connection pipes 21 and 21 have the function of serving as a liquid detecting sensor for detecting whether or not the liquid for drinking is filled within the housing 18.

The liquid detecting sensor has a similar liquid detecting principle to the conductive connection pipes 15 and 15 of the liquid-cut detecting sensor 11 mentioned above.

Figure 4:
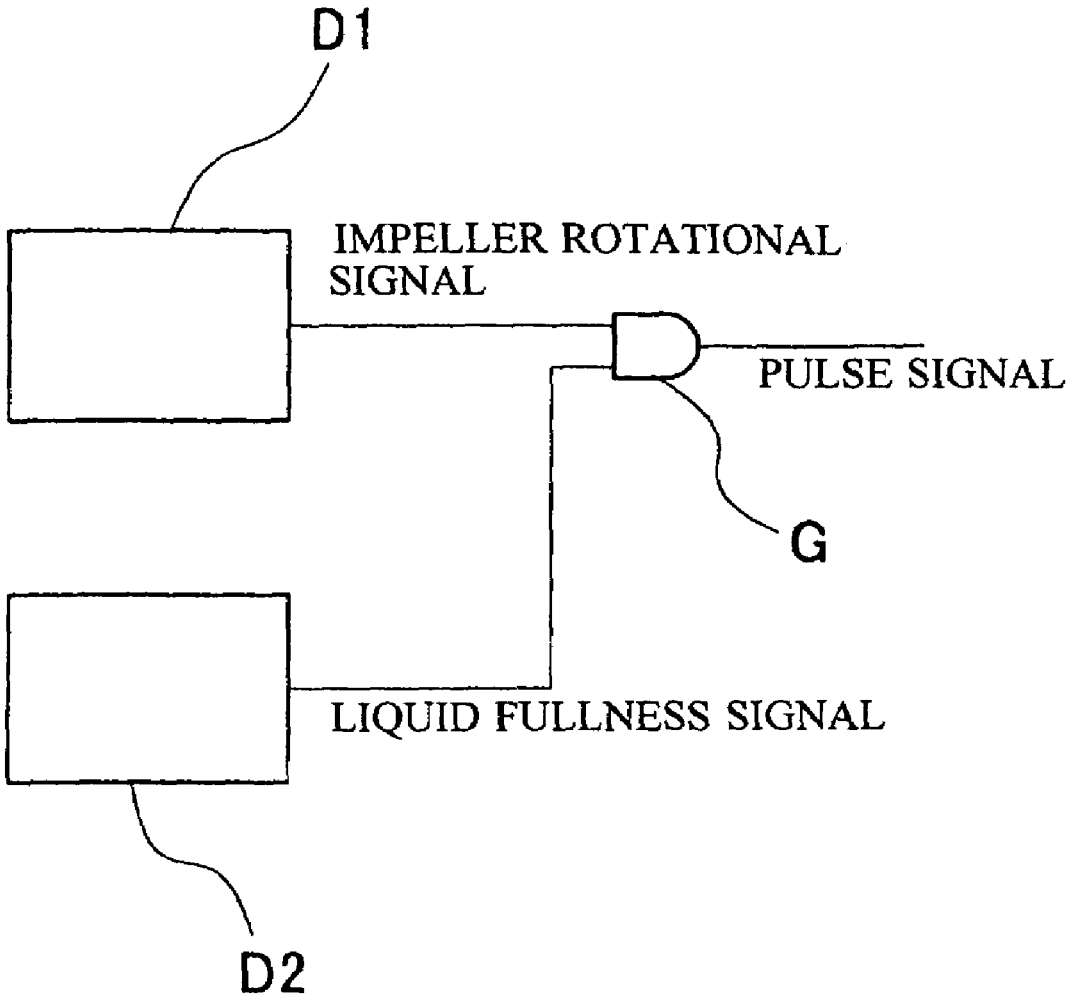
FIG. 4 is a block diagram showing a structure of a rotational pulse generating portion.

The rotational pulse generating portion 22 is provided with an impeller rotation detecting portion D1, a liquid detecting portion D2 and a logic multiplication portion G (refer to FIG. 4).

An analogue peak signal generated by the pickup coil 20 is input to the impeller rotation detecting portion D1 through a wiring 27.

Further, the peak signal is converted into an impeller rotation signal corresponding to a digital rectangular signal by a converting circuit (not shown).

The liquid detecting portion D2 is provided with a function of applying a voltage to two conductive connection pipes 21 and 21 via a wiring 28 and a function of measuring the current flowing in correspondence to the applied voltage.

The measured current value is converted into a liquid fullness signal showing whether or not the liquid for drinking is filled, via a converting circuit for converting into a digital signal of high or low on the basis of a predetermined value.

Further, the rotational pulse generating portion 22 has a function of controlling a pulse signal generation on the basis of the impeller rotation signal detected by the impeller rotation detecting portion D1 and the liquid fullness signal detected by the liquid detecting portion D2.

In other words, the rotational pulse generating portion 22 inhibits the pulse signal from being generated, by inputting the impeller rotation signal and the liquid fullness signal to the logic multiplication portion G.

For example, the logic multiplication portion G structures include two inputs and one output, and is operated such that the output becomes in the high state only in the case that two inputs are simultaneously in the high state.

Next, a description will be given of an operation of the measuring mechanism 5 by using a timing chart shown in FIG. 5.

The impeller rotation signal is generally generated by the rotation of the impeller 19 caused by the flowing of the liquid for drinking filled within the housing 18.

On the other hand, the liquid fullness signal appears as the high state as shown in a period T1 on the basis of the filling of the liquid for drinking within the housing 18.

Figure 5A:
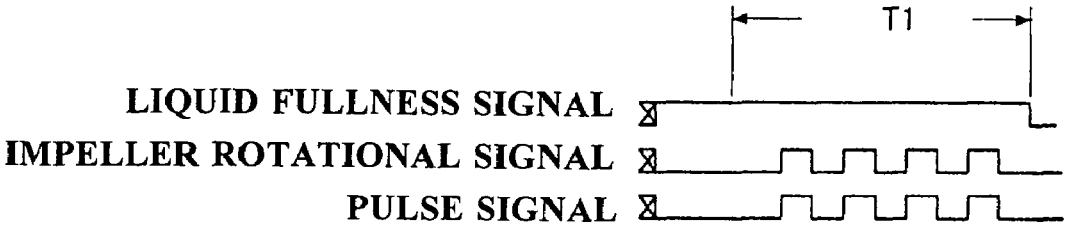
FIGS. 5A and 5B are a timing chart diagram showing a timing of a pulse signal generation in the measuring mechanism on the basis of a relation between a liquid fullness signal and an impeller rotation signal.

When the liquid for drinking is filled within the housing, the liquid fullness signal becomes the high state as shown in the period T1 in FIG. 5A, and the impeller rotation signal becomes the rectangular signal as shown in the drawing.

Accordingly, the rotational pulse generating portion 22 generates the pulse signal which is synchronized with the impeller rotation signal because the liquid fullness signal is the high state.

However, since the liquid for drinking is not filled within the housing 18 when the liquid for drinking of the liquid storage tank 4 runs short, there is established a state in which the bubbles of the liquid for drinking or the compressed gas (from the gas cylinder) flows.

Figure 5B:
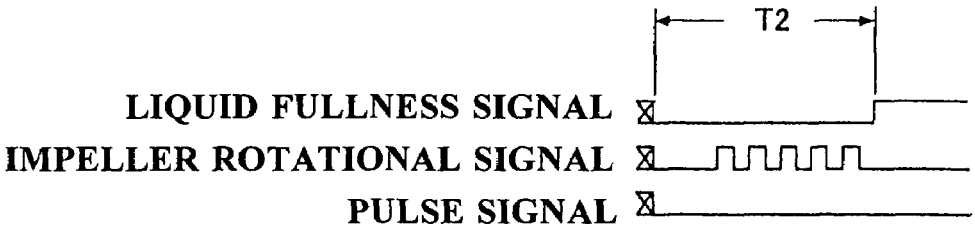

In this case, the impeller 19 is rotated as shown in a period T2 in FIG. 5B in spite of the liquid for drinking not being filled.

Further, since there is established the state in which the liquid for drinking is not filled, that is, the state in which the bubbles of the liquid for drinking or the compressed gas flows, the liquid fullness signal appears as the low state as shown in the drawing.

In this case, the rotational pulse generating portion 22 inhibits the pulse signal from being generated, on the basis of the liquid-cut low-state liquid fullness signal from the liquid detecting portion D2.

In other words, the rotational pulse generating portion 22 can generate the pulse signal only in the case that the liquid for drinking is filled within the housing so as to flow. As a result, it is possible to accurately measure the flow rate of the liquid for drinking.

As mentioned above, the measuring mechanism in accordance with the present invention has a function of measuring the liquid amount only in the state in which the liquid for drinking is filled, by the rotational pulse generating portion 22, and it is possible to securely avoid the conventional erroneous measuring.

In this case, the pulse signal can renew the flow rate display value of the digital box 6 through a wiring 29.

In this case, the reliability of the measuring mechanism 5 can be further improved by duplexing the liquid-cut detecting mechanism 13 and the liquid detecting portion D2 provided in the measuring mechanism 5.

In other words, when the flow rate display value is renewed at a time when the liquid-cut lamp of the liquid-cut detecting mechanism 13 is turned on, the shop tender monitoring the digital box 6 can determine that the liquid detecting portion D2 is out of order.

In this case, the discharging operation of the liquid for drinking is thereafter carried out on the basis of the liquid-cut lamp.

On the other hand, when the liquid-cut lamp is not turned on in spite the flow rate display value not being renewed, it is possible to determine the liquid-cut detecting mechanism 13 is out of order.

In this case, there is a case that the discharging operation is not thereafter carried out, however, the discharging operation of the liquid for drinking is carried out by believing the liquid detecting portion D2 and not depending upon the liquid-cut lamp.

In this case, the liquid for drinking flows into the cooling mechanism 3 through the communication pipe after being measured by the measuring mechanism 5.

The cooling mechanism 3 is structured such as to cool the liquid for drinking discharged from the liquid discharging server 2 via the communication pipe from the liquid storage tank 4 to a proper temperature before the liquid discharging server 2.

Figure 6A:
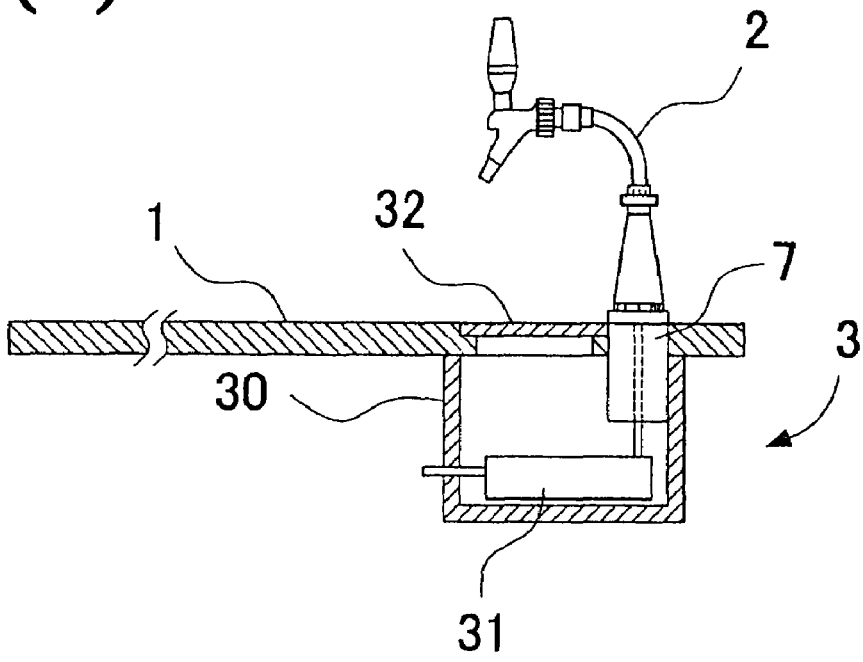
Figure 6B:
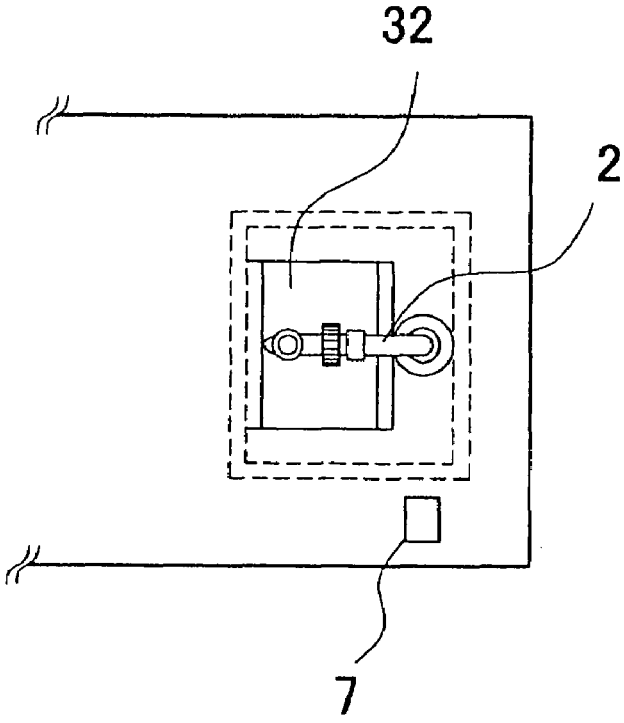

As shown in FIG. 6, the cooling mechanism 3 is generally provided with an ice receiving container 30 holding ice, and a cooling plate 31 arranged in the ice receiving container 30.

A corrugated tube connected to a communication pipe is housed in the cooling plate 31, and is cooled by being brought into contact with the ice (not shown) or the water containing the ice.

The ice receiving container 30 is provided with a lid 32 for putting the ice therein, and it is preferable that the lid is flush to the top surface of the table and is transparent.

In other words, an inner side of the ice receiving container 30 can be easily observed visually through the lid, and the ice supplying period can be appropriately recognized.

The liquid for drinking can be cooled rapidly to a properly chilled temperature by being circulated within the cooled cooling plate 31.

Further, a drain tank (not shown) for discharging the meltwater is prepared in the ice receiving container 30.

The liquid discharging server 2 is installed on the top surface of the table 1, and is structured such as to discharge the liquid for drinking cooled to an optimum temperature via the cooling mechanism 3 in accordance with an opening and closing operation.

Accordingly, the customer can discharge a desired amount of liquid for drinking by freely operating the liquid discharging server 2 at a time when the customer wants to have the liquid for drinking, and an accurate measuring can be secured by the measuring mechanism 5.

The sub set 7 for displaying the drinking amount or the drinking cost is placed on the top surface of the table 1 in a state in which the display portion is directed to an upper side, and the count value of the pulse is displayed on the display portion on the basis of the pulse signal from the digital box 6.

Further, the structure is made such that the display value is counted up at a time when the pulse number of the pulse signal reaches a preset value.

Further, the reset signal from the digital box 6 serves so as to reset the display value of the sub set 7 to zero.

As mentioned above, the sub set 7 can be provided with a money displaying function, a flow rate displaying function, a count-up unit setting function, a set value holding function (a function of holding the set value in a nonvolatile memory even if the power source is turned off) and the like, on the basis of the above basic function.

Second Embodiment

The liquid discharging server 2 placed on the top surface of the table 1 is normally constituted by one liquid discharging server.

However, when the table 1 is large sized, it is preferable that two or more servers are placed because the number of people sitting around the table is increased.

When a plurality of liquid discharging servers 2 are placed in the table 1 as mentioned above, an impact is transmitted to the other liquid discharging server at a time of stopping the discharge of the liquid for drinking in one liquid discharging server 2.

In other words, when the flow of the liquid for drinking is suddenly stopped by the liquid discharging server 2, a pressure is applied to the other liquid discharging server 2, and a shock (a hammer shock) is generated.

Accordingly, in the table 1 in which a plurality of liquid discharging servers 2 are placed, it is important that the communication pipe 10*b* is necessarily provided with a check valve V by which the liquid can fluidize only in one direction corresponding to the discharging direction.

Figure 7:
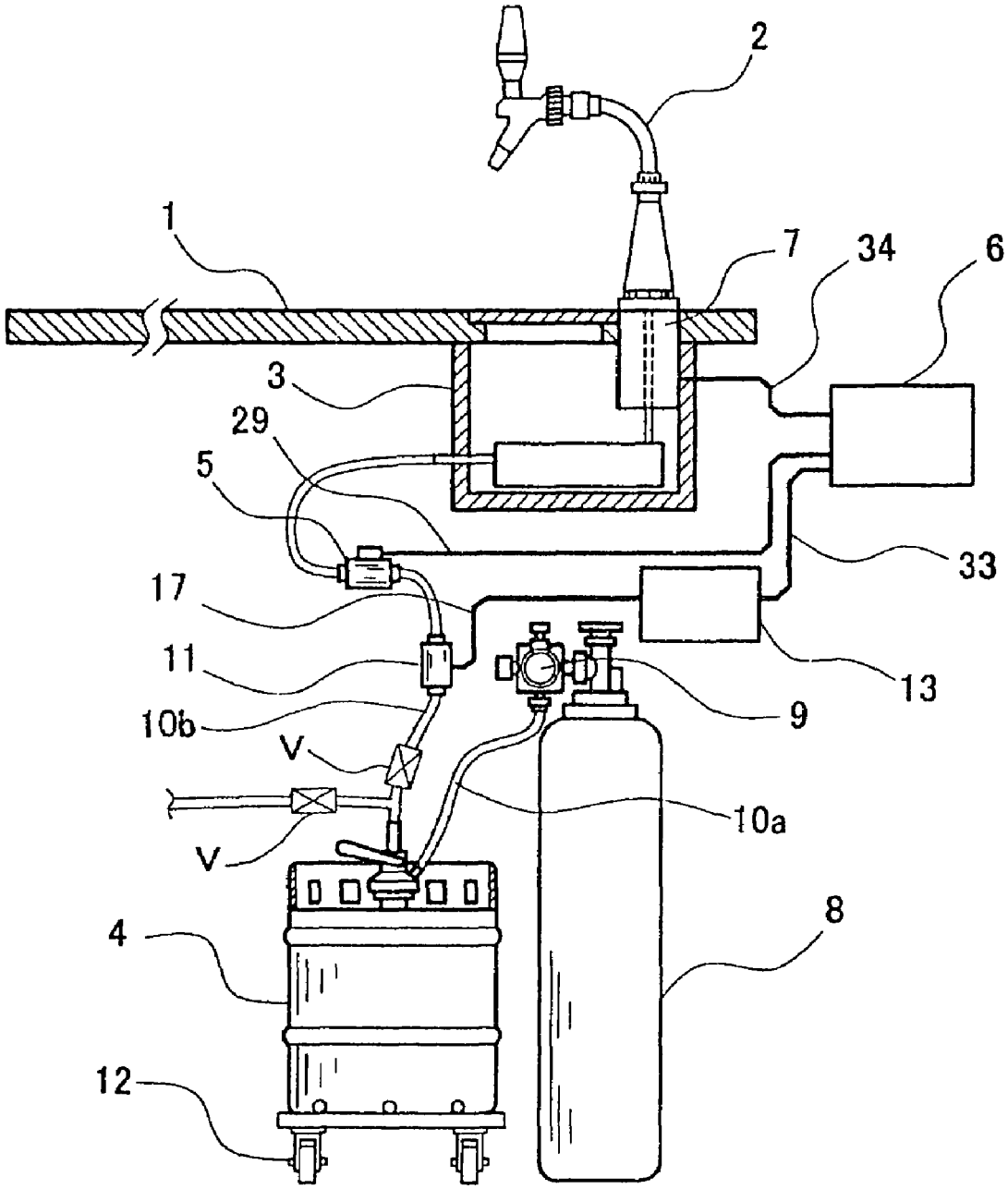
FIG. 7 is a view showing a setting position of a check valve in a drinking table having a plurality of liquid discharging servers.

FIG. 7 is a view showing a position where the check valve is placed in the drinking table having a plurality of liquid discharging servers 2.

The check valve V is mounted to the communication pipe 10*b* near the liquid storage tank 4.

Third Embodiment

There is a case that it is preferable to further lower the temperature of the liquid for drinking discharged from the liquid discharging server.

For example, when the liquid for drinking is beer, beer having a distinctive taste with an increased pungent taste is provided by setting the temperature to −3 to −2° C.

Accordingly, the drinking table is provided with a refrigerating mechanism 40 in addition to the cooling mechanism 3.

Figure 8:
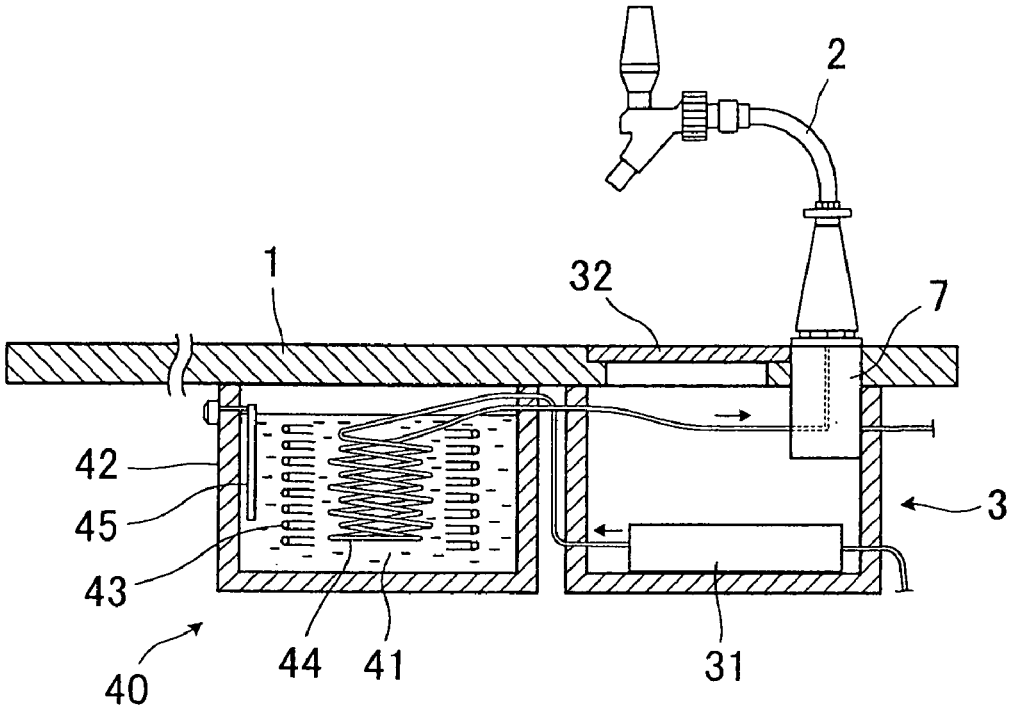
FIG. 8 is a schematic view showing a cooling mechanism and a refrigerating mechanism.

FIG. 8 is a schematic view showing the cooling mechanism 3 having the cooling plate 31 and the refrigerating mechanism 40 having a refrigerating liquid.

A refrigerating liquid 41 is filled in a refrigerating container 42, and a cooling pipe 43 is arranged in the refrigerating liquid in a state of being wound in a coil shape.

A cooling medium gas passes through the cooling pipe 43 and can cool the refrigerating liquid 41 at a minus temperature.

Further, a circulating pipe 44 is arranged so as to be reciprocated in a coil shape.

The liquid for drinking passing through the cooling plate 31 further passes through an inner side of the circulating pipe so as to be cooled by the refrigerating liquid 41 filled in the refrigerating container 42, and the temperature thereof is further lowered.

Accordingly, the beer having the minus temperature is discharged from the liquid discharging server 2.

In general, the temperature which can be cooled by using the cooling mechanism 3 provided with the cooling plate 31 is limited to 0° C., however, beer having a minus temperature can be supplied by using the refrigerating mechanism 40 having the refrigerating liquid, so that it is possible to respond to various tastes.

In this connection, there is a case that a range lower than the minus temperature of the beer is employed in correspondence to the kind of the liquid for drinking.

On the other hand, in the case of a drinking table in which two liquid discharging servers are placed, it is possible to provide two liquids for drinking comprising the liquid for drinking which is cooled only by the cooling mechanism 3, and the liquid for drinking which is cooled by both the cooling mechanism 3 and the refrigerated mechanism 40.

For example, one of two liquid discharging servers forms the cooling path using only the cooling mechanism 3, and another thereof forms the cooling path using both of the cooling mechanism 3 and the refrigerating mechanism 40, whereby it is possible to selectively supply the liquid for drinking having different temperatures.

A rod-like heater 45 arranged in the refrigerating container 42 in FIG. 8 is not normally used.

It is necessary to clean all the passages through which the liquid for drinking passes, after using the drinking table. At this time, the inner side of the circulating pipe is simultaneously cleaned.

In this case, since the refrigerating liquid 41 is lowered to a minus temperature, the cleaning liquid flowing within the circulating pipe is frozen and cannot be cleaned.

Accordingly, the cleaning liquid passes through the inner side of the circulating pipe after heating the refrigerating liquid 41 by using the rod-like heater 45 so as to temporarily heat up to a plus temperature equal to or more than 0° C.

The rod-like heater 45 is extremely important for maintaining the drinking table.

Fourth Embodiment

In this case, the measuring mechanism can employ a measuring mechanism having a different impeller structure.

Figure 9:
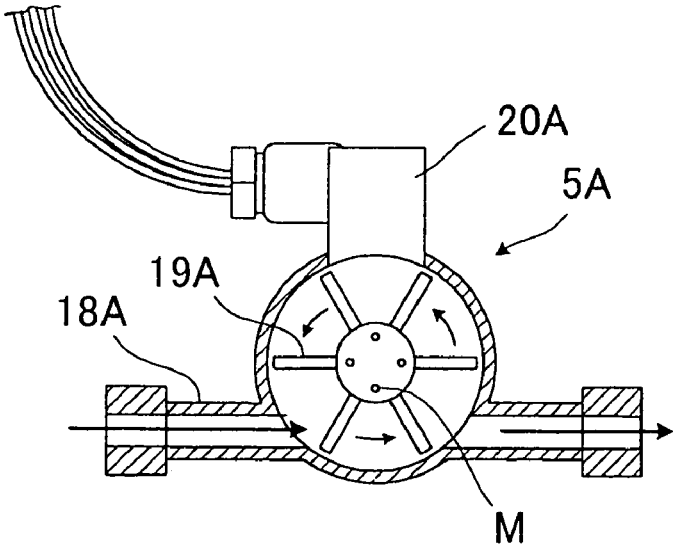
FIG. 9 is a schematic view showing another modified embodiment of the measuring mechanism.

FIG. 9 is a schematic view showing another modified embodiment of the measuring mechanism 5A.

As illustrated, the measuring mechanism 5A in this case is provided with a nonconductive tubular housing 18A, an impeller 19A, a pickup coil (not shown), a liquid detecting sensor (not shown), and a rotational pulse generating portion 22A.

In this case, a magnetic body M is embedded in an axis of the impeller so as to detect the liquid amount.

When the liquid for drinking flows in the direction of the arrow within the housing, the impeller 19A rotates in a clockwise direction, and the pickup coil reads the rotation of the magnetic body M.

The liquid detecting sensor can detect whether or not the liquid is filled within the flow path of the housing.

Further, the function of the rotational pulse generating portion 22A is the same as that of the measuring mechanism in FIG. 3 mentioned above.

The function of the measuring mechanism using the liquid fullness signal and the blade rotation signal is the same as the measuring mechanism in FIG. 3.

The present invention is described above, however, the present invention is not limited to the embodiments mentioned above, and can be variously modified without departing from the purpose thereof.

The liquid for drinking in the present invention is not limited to beer and the present invention can be, of course, applied to other liquids for drinking.

The blade number of the impeller and the number of the magnetic bodies can be appropriately selected in correspondence to the accuracy of measurement of the liquid for drinking.

Further, for example, the control of the rotational pulse generating portion and the sub set may be structured by a micro processor system. In this case, a control process is executed in accordance with a processing procedure in a program mounted to ROM (read-only memory).

Further, for example, the signal line with the digital box can employ various structures such as a current drive by an open collector via a wiring, an optical signal by an inexpensive plastic fiber and the like.

Further, for example, the structure of the cooling mechanism and the refrigerating mechanism can be changed in design as far as the function is obtained.

What is claimed is:

1. A table for supplying a liquid for drinking, comprising:

a liquid discharging server installed in the table;

a liquid storage tank for supplying the liquid for drinking to the liquid discharging server;

a measuring mechanism for measuring a discharged liquid amount, the measuring mechanism being provided with a liquid detection portion and having a function of measuring only in a state in which a forward liquid passage reaching the liquid discharging server is filled with the liquid for drinking; and a cooling mechanism for cooling the liquid for drinking that is provided under the table between the liquid storage tank and the liquid discharging server, the cooling mechanism being provided with an ice receiving container, a cooling plate and a lid for putting the ice therein, and being structured such as to cool the liquid for drinking by circulating the liquid for drinking through the cooling plate, wherein the table is provided with the cooling mechanism at its back side and the lid is placed flush to the surface of the table immediately under a discharge port of the liquid discharging server.

2. A table for supplying a liquid for drinking, comprising:

a liquid discharging server installed in the table;

a liquid storage tank for supplying the liquid for drinking to the liquid discharging server;

a measuring mechanism for measuring a discharged liquid amount, the measuring mechanism being provided with a liquid detection portion, having a function of measuring only in a state in which a forward liquid passage reaching the liquid discharging server is filled with the liquid for drinking, being provided between the liquid discharging server and the liquid storage tank, and being provided with an impeller rotated by the liquid for drinking flowing through a liquid passage within a housing, an impeller rotation detecting portion for detecting the rotation of the impeller and a liquid detecting portion for detecting whether or not the liquid passage is filled with the liquid for drinking; and a cooling mechanism for cooling the liquid for drinking that is provided under the table between the liquid storage tank and the liquid discharging server, the cooling mechanism being provided with an ice receiving container, a cooling plate and a lid for putting the ice therein, and being structured such as to cool the liquid for drinking by circulating the liquid for drinking through the cooling plate, wherein the table is provided with the cooling mechanism at its back side, the lid is placed flush to the surface of the table immediately under a discharge port of the liquid discharging server and a pulse signal for measuring the liquid amount is controlled by an impeller rotation signal detected by the impeller rotation detecting portion and a liquid fullness signal detected by the liquid detecting portion.

3. A table for supplying a liquid for drinking as claimed in claim 1, wherein the liquid storage tank is received in a lower side of the table.

4. A table for supplying a liquid for drinking as claimed in claim 3, wherein the liquid storage tank is provided with a caster and is structured so as to be movable.

5. A table for supplying a liquid for drinking as claimed in claim 1, wherein a display portion detecting and displaying the liquid amount measured by the measuring mechanism is provided in a counter which is apart from the table.

6. A table for supplying a liquid for drinking as claimed in claim 1, wherein a plurality of liquid discharging servers are placed in the table.

7. A table for supplying a liquid for drinking as claimed in claim 6, wherein a communication pipe for feeding the liquid for drinking to the liquid discharging server is provided with a check valve for allowing the liquid for drinking to flow only in one direction corresponding to a discharging direction.

8. A table for supplying a liquid for drinking as claimed in claim 1, wherein a cooling mechanism for cooling the liquid for drinking and a refrigerating mechanism for cooling the liquid for drinking to a minus temperature are provided between the liquid storage tank and the liquid discharging server.

9. A table for supplying a liquid for drinking as claimed in claim 1, wherein the liquid passage is provided with a liquid-cut detecting mechanism.

* * * * *